US008302656B2

(12) United States Patent
Bedford

(10) Patent No.: US 8,302,656 B2
(45) Date of Patent: Nov. 6, 2012

(54) METHOD OF CASTING

(75) Inventor: Paul Bedford, Exmouth (GB)

(73) Assignees: Honeywell UK Limited, Bracknell (GB); Honeywell Aerospace BV, Amsterdam (NL)

( * ) Notice: Subject to any disclaimer, the term of this patent is extended or adjusted under 35 U.S.C. 154(b) by 0 days.

(21) Appl. No.: 12/782,539

(22) Filed: May 18, 2010

(65) Prior Publication Data

US 2010/0294453 A1 Nov. 25, 2010

(30) Foreign Application Priority Data

May 19, 2009 (GB) ..... 0908524.2

(51) Int. Cl.
*B22D 27/15* (2006.01)
*B22D 41/00* (2006.01)
*B22D 41/50* (2006.01)

(52) U.S. Cl. ..... 164/61; 164/253; 164/337

(58) Field of Classification Search ..... 164/61, 164/65, 253, 254, 256, 337
See application file for complete search history.

(56) References Cited

U.S. PATENT DOCUMENTS 3,700,026 A * 10/1972 Adachi et al. ..... 164/256
3,998,264 A 12/1976 Hocking
4,390,362 A * 6/1983 Khusnutdinov et al. ..... 75/509
4,538,671 A 9/1985 Waterstrat
4,549,600 A * 10/1985 Kauserud ..... 164/323

FOREIGN PATENT DOCUMENTS

| | | | |
|---|---|---|---|
| EP | 0387107 | A2 | 9/1990 |
| FR | 678106 | A | 3/1930 |
| GB | 1011016 | A | 11/1965 |
| JP | 10085920 | A | 4/1998 |

OTHER PUBLICATIONS

Search Report for GB0908524.2, dated Jun. 18, 2009.

* cited by examiner

*Primary Examiner* — Kevin P Kerns
(74) *Attorney, Agent, or Firm* — Marshall, Gerstein & Borun LLP

(57) ABSTRACT

A method of casting a molten metal into a mould uses an apparatus which has a casting chamber which includes a mould into which molten metal is introduced when the casting chamber is at least partially evacuated, to fill the mould, a tundish connected to the casting chamber, the tundish having an opening in register with an inlet aperture of the casting chamber to provide an inlet flow path for the molten metal from the tundish into the casting chamber, a plug which includes a sealing part of a material with a melting temperature not greater than the temperature of the metal being cast, the method including locating the plug to close the molten metal flow path, at least partially evacuating the casting chamber, pouring a volume of molten metal into the tundish sufficient to provide the casting, whereby at least the sealing part of the plug melts to permit molten metal to flow along the flow path into the casting chamber.

21 Claims, 2 Drawing Sheets

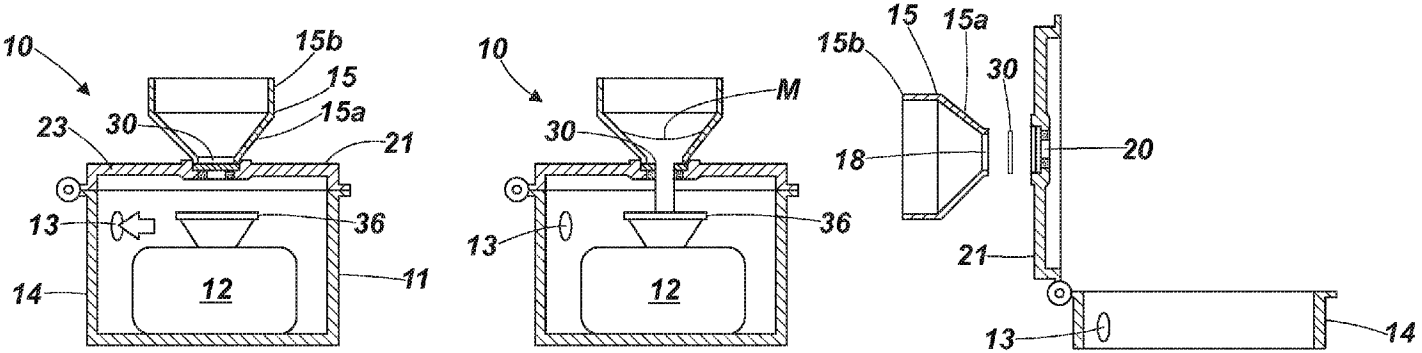
Fig. 1
Fig. 2
Fig. 3
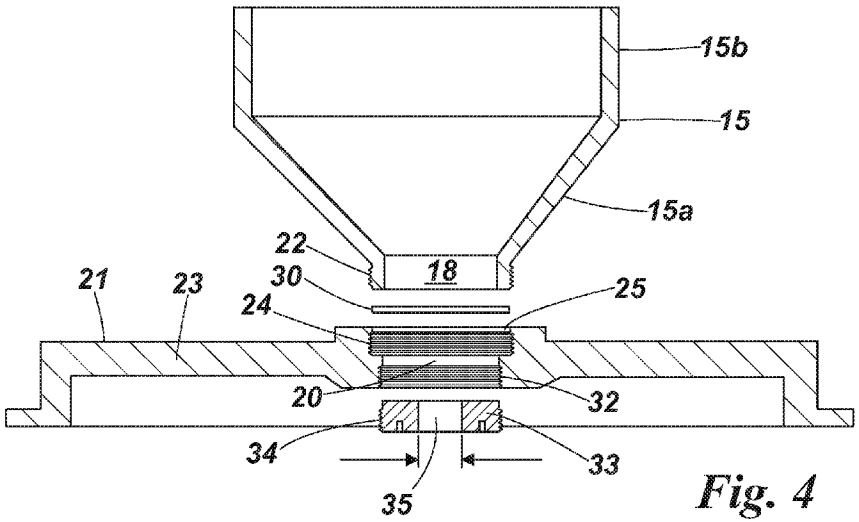
Fig. 4

METHOD OF CASTING

BACKGROUND TO THE INVENTION

This invention relates to a method of casting a molten metal into a mould, and to an apparatus which may be used for performing the method.

DESCRIPTION OF THE PRIOR ART

It is known that high integrity metal castings typically of aluminium or aluminium alloy, may be produced by introducing the molten metal into the mould with the mould at least partially evacuated, so as to avoid the introduction of atmospheric contaminants into the casting and to preclude the formation of air bubbles in the casting and facilitate the filling of thin walled sections.

However existing proposals for apparatus to perform such casting methods require the use of a furnace ladle which is filled with molten metal from a transfer ladle. The furnace ladle and the mould are then introduced together into a casting chamber which is then evacuated, and then the molten metal in the furnace ladle is poured into the mould, by rotating the furnace ladle.

Such apparatus, and the casting method employed are complex, and heat losses during the whole process are higher than is desirable. Accordingly the molten metal has to be superheated to temperatures well above the melting temperature to ensure that the metal remains molten or sufficiently so during the whole casting process.

Because the molten metal is poured from the furnace ladle into the mould, and the furnace ladle tends to be controlled from outside of the evacuated casting chamber, i.e. remotely, there is an enhanced risk of molten metal spillage, and the flow necessarily will have turbulence due to the trajectory of the metal as it is poured into the mould.

SUMMARY OF THE INVENTION

According to a first aspect of the invention we provide a method of casting a molten metal into a mould using an apparatus which has a casting chamber which includes a mould into which molten metal is introduced when the casting chamber is at least partially evacuated, to fill the mould. The apparatus may include a tundish connected to the casting chamber, the tundish having an opening in register with an inlet aperture of the casting chamber to provide an inlet flow path for the molten metal from the tundish into the casting chamber. The apparatus may include a plug which includes a sealing part of a material with a melting temperature not greater than the temperature of the metal being cast. The method may include locating the plug to close the molten metal flow path, at least partially evacuating the casting chamber, pouring a volume of molten metal into the tundish sufficient to provide the casting whereby at least the sealing part of the plug melts to permit molten metal to flow along the flow path into the casting chamber.

The present invention provides a casting method which is simpler than the prior proposal described above, with significantly less heat losses as there is no need for the intermediary of a furnace ladle. Rather the molten metal may be poured into the tundish directly from a transfer ladle, and there is no idle time waiting for the casting chamber to be evacuated with a loaded furnace ladle in the casting chamber.

Moreover, the inlet aperture may be provided from an upper surface of the casting chamber, so that the molten metal flows directly downwardly from the tundish into the mould with no trajectory, resulting in much smoother, more consistent pouring of the molten metal, virtually eliminating the risk of spillage.

The more consistent pouring of the molten metal, with less turbulence and an at least partially evacuated mould cavity, results in a reduced inclination towards gas formation in the casting. Thus overall a higher metallurgical integrity level casting may be produced.

Desirably the method includes pouring a volume of molten metal into the tundish which is not significantly greater than the volume of the casting to be produced by the method.

It will be appreciated that when all of the poured molten metal has flowed into the casting chamber along the flow path, the inlet aperture to the casting chamber and the opening of the tundish will no longer be sealed by the molten metal, and accordingly air may enter the casting chamber to relieve the at least partial vacuum. This is desirable as the introduction of cool air into the casting chamber at this stage assists with the final filling of the mould and promotes cooling of the casting chamber and thus solidification of the metal in the mould giving better environmental conditions for the promotion or enhancement of mechanical properties in the casting.

It will be appreciated that as the sealing part of the plug melts, molten material will be introduced into the casting chamber. Preferably the plug, or at least the sealing part of the plug, is made of the same or similar metal, or substantially so, as the molten metal is cast, such that the method includes selecting a plug in which the sealing part is made of a substantially similar metal to that being cast.

Thus where the metal being cast is for example an alloy such as for example, an aluminium alloy which is predominantly of one metal i.e. in the example, aluminium, the plug, or at least the sealing part of the plug which in use is melted by the molten metal introduced into the tundish is, in the example, aluminium, alloy, or at least of the one metal, i.e. in the example, aluminium.

The opening of the tundish may have a first engagement formation and the aperture of the casting chamber may have a second engagement formation, the first and second engagement formations being engageable prior to the molten metal being poured into the tundish, with the plug device located to close the molten metal flow path from the tundish to the casting chamber, and subsequent to casting the engagement formations being separable to enable any residual plug material to be removed and replaced with a fresh plug for performing further casting.

The mould in the at least partially evacuated casting chamber may include a receiving cup, and the method may include locating the mould in the casting chamber with the receiving cup directly below the casting chamber inlet aperture, so that the cup receives molten metal from casting chamber inlet aperture.

The casting chamber may have an opening by means of which the mould may be located in the casting chamber, the opening being closable e.g. by a door, to permit the casting chamber to be at least partially evacuated. In one example, at least a portion of a top wall of the casting chamber (which may provide the inlet upper surface in which the inlet aperture is provided) may be hinged or otherwise openable to permit the mould to be located in the casting chamber and the casting removed from the casting chamber. Alternatively, the opening could be in a side wall of the casting chamber.

According to a second aspect of the invention we provide an apparatus for casting a molten metal into a mould, the apparatus having a casting chamber which includes the mould, the casting chamber including an inlet aperture for molten metal, a device to withdraw air and at least partially to evacuate the casting chamber, a tundish which at least in use, is connected to the casting chamber, the tundish having an opening in register with an inlet aperture of the casting chamber, an inlet flow path for the molten metal from the tundish into the casting chamber provided by the opening of the tundish and the inlet aperture of the casting chamber, a plug which includes a sealing part of a material with a melting temperature not greater than the temperature of the metal being cast, the plug being locatable prior to casting to close the molten metal flow path in a location such that when molten metal is poured into the tundish, the plug is contacted by the molten metal and the plug, or at least a sealing part of the plug, melts to permit the molten metal to flow along the flow path into the casting chamber.

BRIEF DESCRIPTION OF THE DRAWINGS

Exemplary embodiments of the invention with now be described with reference to the accompanying drawings in which:

FIG. 1 is an illustrative view of an apparatus for use in performing the method of the invention at one stage in the method;

FIG. 2 is a view similar to FIG. 1 but of a second stage in the method;

FIG. 3 is a view of part of the apparatus shown in FIGS. 1 and 2 subsequent to casting;

FIG. 4 is an enlarged exploded illustrative more-detailed view of part of the apparatus for casting of the previous figures;

DESCRIPTION OF THE PREFERRED EMBODIMENTS

Figure 5:
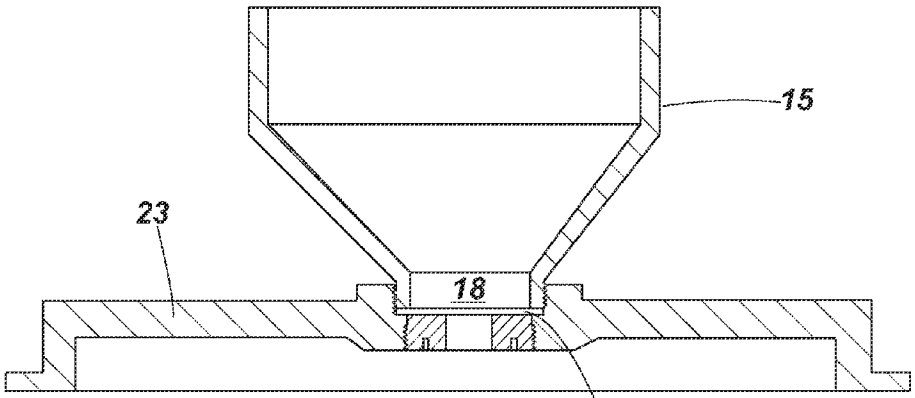
FIG. 5 is a view similar to FIG. 4 but showing the parts assembled.

Referring to FIGS. 1 to 5 of the drawings, a casting apparatus 10 is shown. The apparatus has a casting chamber 11 which includes a mould 12 into which molten metal M is introduced when the casting chamber 11 is at least partially evacuated, to fill the mould 12.

To enable the casting chamber 11 to be evacuated, in a side wall 14 of the casting chamber 11, there is an outlet 13 which in use is connected to a vacuum source, such as a pump which withdraws air from the casting chamber 11.

The apparatus 10 further includes a tundish 15 connected to the casting chamber 11. In the example, the tundish 15 is separable from the casting chamber 11 as will be described, but if desired in another embodiment, the tundish 15 or at least a part of the tundish 15 could be permanently fixed to or integral with the casting chamber 11.

The tundish 15 in the example has a generally conical lower part 15*a*, and a cylindrical upper part 15*b*. In a base of the cone there is an opening 18. The opening 18 is in register with an inlet aperture 20 in an upper surface 21 of a top wall 23 of the casting chamber 11, and together the tundish opening 18 and casting chamber inlet aperture 20 provide an inlet flow path for the molten metal from the tundish 15 into the casting chamber 11.

Referring now particularly to FIGS. 4 and 5 it can be seen that the tundish 15 has a first engagement formation 22, namely a male thread surrounding the opening 18, and the inlet aperture 20 of the casting chamber 11 has a second engagement formation 24 namely a corresponding female thread in the inlet aperture 20. The male and female threads 22, 24 are engageable to permit the tundish 15 to be connected to the top wall 23 of the casting chamber 11.

However the inlet aperture 20 of the casting chamber 11 includes a recess 25 at its uppermost end, in which recess 25 a plug 30 is in use received. When the tundish 15 is connected to the casting chamber 11, by screwing the male and female threads 22, 24 together, the plug 30 is received in the recess 25 and becomes trapped between and forms a seal with the tundish 15 and the casting chamber 11 top wall 23, as can be seen in FIG. 5.

The plug 30 when thus located will close the molten metal flow path from the tundish 15 to the casting chamber 11.

The plug 30 is in this example a simple disc or plate which is entirely made of the same or a similar metal as that which is to be cast. However in another example, the plug 30 may be of a complex configuration with only a sealing part of the plug 30 made of the same or a similar metal as the metal to be cast.

In the generality the plug 30, or at least a sealing part of the plug 30 is of a material with a melting temperature not greater than the temperature of the metal being cast.

Referring again to FIGS. 4 and 5, in the inlet aperture 20, a second female thread 32 is provided, with which an interchangeable nozzle 33 may be engaged, the nozzle 33 having a corresponding male thread 34. A nozzle 33 may be selected for engagement in the inlet aperture 20 which has a through opening 35 of a fixed size. By varying the size of the through opening 35, depending on the nature of the metal being cast, and/or the size and complexity of the casting to be produced, or any other factors which may affect the metallurgical integrity of the casting to be produced, an optimum flow rate for the molten metal M into the casting chamber 11 may be provided.

In another example, if desired, the flow path for the molten metal need not include any interchangeable nozzle 33 where not required. In this case, the inlet aperture 20 need not have the second thread 32.

Figure 6:
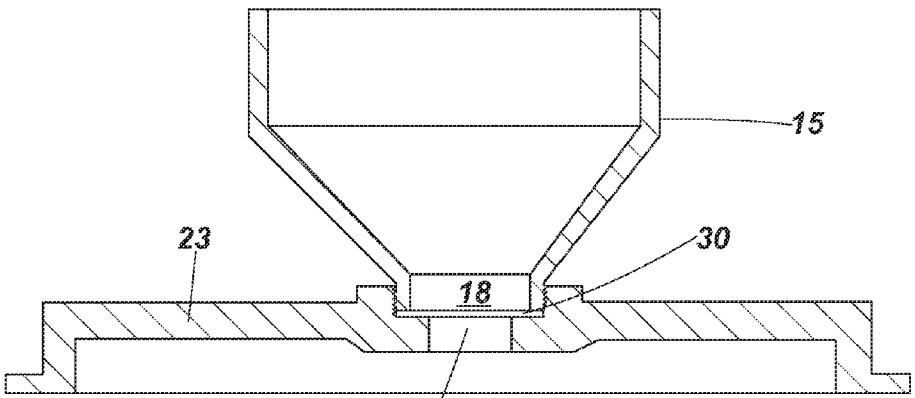
FIG. 6 is a view similar to FIG. 5 but of a modification.
Figure 7:
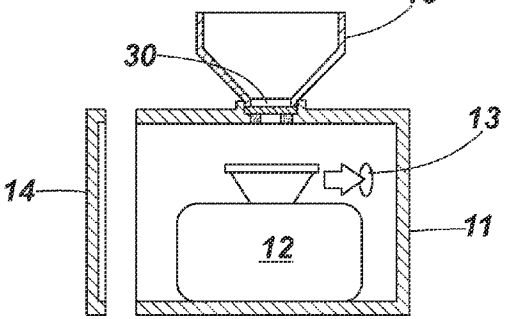
FIG. 7 is a view similar to FIG. 1 of an alternative embodiment.

Such an embodiment is indicated in FIG. 6 where similar parts to the FIGS. 1 to 5 embodiment have the same references.

The mould 12 may be provided by a vessel formed of sand, ceramic or other material, with a cavity therein of a shape corresponding to the casting to be produced. By performing the method of the invention, very thin sections can be cast with high metallurgical integrity, and thus the mould 12 may be complex.

In the example, the mould 12 includes an open bottomed pouring cup 36 which is a truncated cone, to facilitate pouring of the molten metal into the cavity provided by the mould 12.

In preparation for casting, the mould 12 is located in the casting chamber 11. This is achieved as the top wall 23 of the casting chamber 11, but in another embodiment a side wall 14 or a part of any wall of the casting chamber 11, is openable.

In the example, the top wall 23 is hinged to the remainder of the casting chamber 11 as indicated in FIG. 3. The wall 23, or a door where only part of a wall is open, closes the casting chamber when the mould 12 is located inside the casting chamber 11 with the pouring cup 36 immediately below the inlet aperture 20.

In FIG. 6, a construction with an opening in the side wall 14 is illustrated. Similar parts to FIG. 1 are indicated by the same references. In this example, the side wall 14, or a part thereof, is separable from the remainder of the casting chamber 11 to permit the mould 12 to be located in the casting chamber 11, and then the side wall 14, or part thereof, or a door for the opening, is secured to the remainder of the casting chamber 11.

In each case, the casting chamber 11 is then at least partially evacuated by operating the vacuum pump or otherwise connecting the casting chamber 11 to a vacuum source so that air is withdrawn from the casting chamber 11.

When the casting chamber 11 has been evacuated to a desired degree, a volume of molten metal M is poured into the tundish 15 directly from a transfer ladle which has been loaded with molten metal from a melting furnace.

The volume poured into the tundish 15 is at least sufficient to provide casting in the mould 12. It will be appreciated from the explanation below that if the volume poured into the tundish 15 is significantly greater than that of the casting to be produced in the mould 12, there may be spillage of metal M into the casting chamber 11.

Upon the molten metal volume M being poured into the tundish 15, the sealing part of the plug 30, or perhaps even all of the plug 30, will melt when contacted by the molten metal (see FIG. 2), and thus the plug 30 will cease to close the flow path for the molten metal into the casting chamber 11 and hence into the mould 12.

As the plug 30, or sealing part of the plug 30 may melt rapidly, the molten metal needs to be poured into the tundish 15 reasonably quickly, or at least as fast as the molten metal flows into the casting chamber 11. This is where the use of a nozzle 33 to control the rate of molten metal flow would be of use to regulate the flow rate generated by the force of atmospheric pressure on the molten metal M.

Provided that some of the volume of molten metal is still present in the tundish 15 once the plug 30 or at least the sealing part of the plug 30 has melted so that the casting chamber 11 is no longer sealed by the plug 30, a seal will be maintained by the molten metal M against the ingress of air into the at least partially evacuated casting chamber 11.

Because the molten metal passes from the tundish 15 downwardly only, and because air in the casting chamber 11 is excluded, the flow of molten metal down into the mould will be consistently smooth. The risk of spillage of molten metal M is virtually non-existent as the molten metal M does not need to flow along any trajectory as with conventional methods in which the molten metal is poured from a ladle into the mould 12.

As soon as all the volume of molten metal M has flowed from the tundish 15 towards the casting chamber 11 beneath, it will be appreciated that the air seal provided by the molten metal M will be broken, and air is admitted into the casting chamber 11 along the flow path to relieve the at least partial vacuum.

This is advantageous as the introduction of cool air into the casting chamber 11 at this stage assists with the final filling of the mould 12 due to the increased pressure to which the metal in the mould 12 will be subject. Moreover the cool air promotes cooling of the casting chamber 11 and thus solidification of the metal in the mould 12.

The invention may be applied for producing aluminium or aluminium alloy castings. In this event, the plug 30, or sealing part of the plug 30 at least, is preferably made of aluminium, and could even be made of the specific aluminium alloy.

Various modifications may be made without departing from the scope of the invention. For example, in the embodiment illustrated, the tundish 15 may be separated from the casting chamber 11 by virtue of the engaging male and female threads 22, 24, but in another example, these need not be separable although in that case a suitable mechanism will be required to locate the plug 30 to close the molten metal flow path between the tundish 15 and the casting chamber 11 to permit a partial vacuum to be established in the casting chamber 11 ahead of the poured molten metal melting the plug 30.

Access to the casting chamber 11 to allow the location of the mould 12 in the casting chamber 11 and removal of the casting produced from the chamber 11 may be achieved otherwise than by a hinged top wall 23 as in the example. For example a door may be provided in the top wall 23 or a side wall 13, or even in a base of the casting chamber 11, large enough to accommodate the mould 12.

The invention claimed is:

1. A method of casting a molten metal into a mould using an apparatus which has a casting chamber which includes a mould into which molten metal is introduced when the casting chamber is at least partially evacuated, to fill the mould, a tundish connected to the casting chamber, the tundish having an opening in register with an inlet aperture of the casting chamber to provide an inlet flow path for the molten metal from the tundish into the casting chamber, a plug which includes a sealing part of a material with a melting temperature not greater than the temperature of the metal being cast, and an interchangeable nozzle in the inlet aperture which has a through opening of a fixed size, the method including selecting a nozzle for engagement in the inlet aperture in order to achieve an optimum flow rate of molten metal into mould, locating the plug to close the molten metal flow path, at least partially evacuating the casting chamber, pouring a volume of molten metal into the tundish sufficient to fill the mould whereby at least the sealing part of the plug melts to permit molten metal to flow along the flow path through the nozzle into the casting chamber.

2. A method according to claim 1 wherein the molten metal is poured into the tundish directly from a transfer ladle.

3. A method according to claim 1 wherein the inlet aperture is provided from an upper surface of the casting chamber, and the molten metal thus flows directly downwardly from the tundish into the mould.

4. A method according to claim 1 wherein the method includes pouring a volume of molten metal into the tundish which is not significantly greater than the volume of the casting to be produced by the method.

5. A method according to claim 1 wherein the method includes, when all of the poured molten metal has flowed into the casting chamber along the flow path, when the inlet aperture to the casting chamber and the opening, the tundish will no longer be sealed by the molten metal, permitting air to enter the casting chamber.

6. A method according to claim 1 wherein the method includes selecting a plug in which the sealing part is made of a substantially similar metal to that being cast.

7. A method according to claim 6 wherein the metal being cast is an alloy which is predominantly one metal, the plug, or at least the sealing part of the plug which in use is melted by the molten metal introduced into the tundish, is selected to be of the alloy, or at least of the one metal.

8. A method according to claim 1 wherein the opening of the tundish has a first engagement formation and the aperture of the casting chamber has a second engagement formation, the method including engaging the first and second engagement formations prior to the molten metal being poured into the tundish, with the plug located to close the molten metal flow path from the tundish to the casting chamber.

9. A method according to claim 8 wherein subsequent to casting the method includes separating the first and second engagement formations.

10. A method according to claim 1 wherein the mould includes a receiving cup, and the method includes locating the mould in the casting chamber with the receiving cup directly below the casting chamber inlet aperture, so that the cup receives molten metal from the casting chamber inlet aperture.

11. A method according to claim 1 wherein the casting chamber has an opening by means of which the mould is locatable in the casting chamber, the method including closing the opening to permit the casting chamber to be at least partially evacuated.

12. A method according to claim 11 wherein at least a portion of a top or side wall of the casting chamber is openable to permit the mould to be located in the casting chamber and the casting removed from the casting chamber.

13. An apparatus for casting a molten metal into a mould, the apparatus having a casting chamber which includes the mould, the casting chamber including an inlet aperture for molten metal, a device to withdraw air and at least partially to evacuate the casting chamber, a tundish which at least in use, is connected to the casting chamber, the tundish having an opening in register with an inlet aperture of the casting chamber, an inlet flow path for the molten metal from the tundish into the casting chamber provided by the opening of the tundish and the inlet aperture of the casting chamber, a plug which includes a sealing part of a material with a melting temperature not greater than the temperature of the metal being cast, the plug being locatable prior to casting to close the molten metal flow path in a location such that when molten metal is poured into the tundish, the plug is contacted by the molten metal, the plug, and at least the sealing part melts to permit the molten metal to flow along the flow path into the casting chamber, wherein the apparatus includes an interchangeable nozzle engageable in the inlet aperture which has a through opening of a fixed size.

14. An apparatus according to claim 13 wherein the inlet aperture is provided in an upper surface of the casting chamber.

15. An apparatus according to claim 13 wherein the sealing part of the plug is made of a substantially similar metal to that being cast.

16. An apparatus according to claim 13 wherein the opening of the tundish has a first engagement formation and the aperture of the casting chamber has a second engagement formation, the first and second engagement formations being engageable with the plug located to close the molten metal flow path from the tundish to the casting chamber.

17. An apparatus according to claim 13 wherein the mould includes a receiving cup locatable directly below the casting chamber inlet aperture, so that in use the cup receives molten metal from the casting chamber inlet aperture.

18. An apparatus method according to claim 13 wherein the casting chamber has an opening by means of which the mould is locatable in the casting chamber, the opening being closeable to permit the casting chamber to be at least partially evacuated.

19. An apparatus according to claim 18 wherein at least a portion of a wall of the casting chamber provides the opening.

20. A method of casting a molten metal into a mould using an apparatus which has a casting chamber which includes a mould into which molten metal is introduced when the casting chamber is at least partially evacuated, to fill the mould, a tundish connected to the casting chamber, the tundish having an opening in register with an inlet aperture of the casting chamber to provide an inlet flow path for the molten metal from the tundish into the casting chamber, a plug which includes a sealing part of a material with a melting temperature not greater than the temperature of the metal being cast, and an interchangeable nozzle engageable with a thread in the inlet aperture, the nozzle having a through opening of a fixed size, the method including selecting a nozzle for engagement in the inlet aperture in order to achieve an optimum flow rate of molten metal into the mould, engaging the nozzle with the thread in the inlet aperture, locating the plug to close the molten metal flow path, at least partially evacuating the casting chamber, pouring a volume of molten metal into the tundish sufficient to fill the mould whereby at least the sealing part of the plug melts to permit molten metal to flow along the flow path through the nozzle and into the casting chamber.

21. An apparatus for casting a molten metal into a mould, the apparatus having a casting chamber which includes the mould, the casting chamber including an inlet aperture for molten metal, a device to withdraw air and at least partially to evacuate the casting chamber, a tundish which at least in use, is connected to the casting chamber, the tundish having an opening in register with an inlet aperture of the casting chamber, an inlet flow path for the molten metal from the tundish into the casting chamber provided by the opening of the tundish and the inlet aperture of the casting chamber, a plug which includes a sealing part of a material with a melting temperature not greater than the temperature of the metal being cast, the plug being locatable prior to casting to close the molten metal flow path in a location such that when molten metal is poured into the tundish, the plug is contacted by the molten metal, the plug, and at least the sealing part melts to permit the molten metal to flow along the flow path into the casting chamber, wherein the apparatus includes an interchangeable nozzle engageable with a thread in the inlet aperture which nozzle has a through opening of a fixed size.

* * * * *